US012012808B2

(12) United States Patent
Shalouf

(10) Patent No.: US 12,012,808 B2
(45) Date of Patent: Jun. 18, 2024

(54) SYSTEMS AND METHOD TO PROTECT A DRILLING RIG

(71) Applicant: Saudi Arabian Oil Company, Dhahran (SA)

(72) Inventor: Fathalla Shalouf, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 303 days.

(21) Appl. No.: 17/409,496

(22) Filed: Aug. 23, 2021

(65) Prior Publication Data

US 2023/0060029 A1 Feb. 23, 2023

(51) Int. Cl.
*E21B 15/00* (2006.01)
*E04H 12/34* (2006.01)

(52) U.S. Cl.
CPC ..... *E21B 15/00* (2013.01); *E04H 12/345* (2013.01)

(58) Field of Classification Search
CPC ..... E21B 15/00; E04H 12/345
See application file for complete search history.

(56) References Cited

U.S. PATENT DOCUMENTS 212,688 A * 2/1879 Name ..... B61F 5/06 267/168
1,720,828 A * 7/1929 Fentress ..... E21B 19/14 211/70.4
1,810,720 A * 6/1931 Kenneth ..... E21B 19/14 211/70.4
2,808,911 A 10/1957 Mclerran
2,993,570 A 7/1961 Bender
3,245,180 A 4/1966 Bules
3,747,695 A 7/1973 Branham
4,447,997 A 5/1984 Delgado
2013/0340355 A1 12/2013 Flusche
2016/0341278 A1* 11/2016 Kester ..... F16G 11/12
2020/0048965 A1 2/2020 Chen
2021/0054645 A1 2/2021 Shalouf

FOREIGN PATENT DOCUMENTS

GB 2158488 A * 11/1985 ..... E21B 15/04

* cited by examiner

*Primary Examiner* — Babajide A Demuren
(74) *Attorney, Agent, or Firm* — Fish & Richardson P.C.

(57) ABSTRACT

A drilling rig system includes a mast that includes one or more front legs, one or more rear legs positioned opposite the one or more front legs, and a crown block at the top of the mast. The system also includes a raising line coupled to the crown block or the one or more rear legs and configured to apply a first force to the mast. The first force acts in a direction opposing a second force generated by the weight of the mast as the mast pivots between a substantially horizontal position and a substantially vertical position. The system also includes a drawworks assembly coupled to the raising line and configured to pull the raising line to generate the first force, and a telescoping spring assembly coupled to the one or more front legs. The telescoping spring assembly is configured to apply a third force to the mast that acts in the direction opposing the second force.

13 Claims, 3 Drawing Sheets

SYSTEMS AND METHOD TO PROTECT A DRILLING RIG

TECHNICAL FIELD

This disclosure relates to apparatus, systems, and methods to protect a mast of a drilling rig, and, more particularly, to protect the rig during raising and lowering a mast of the drilling rig.

BACKGROUND

Drilling rigs for oil and gas operations typically include a mast structure. The mast of a drilling rig is used to provide support to a crown block and a drill string of the rig. Drilling rig masts are typically positioned in a horizontal orientation during transportation of the rig to the drilling site, and are then raised to a substantially vertical position at the drilling site. The mast is typically raised at the drilling site using a raising line system or other raising device. Failure of the raising device during the process of raising or lowering the mast can cause the mast to collapse, resulting in damage to the mast and increased risk of injury to personnel at the drilling site. Mechanical failures of mast raising devices are difficult to predict or detect, making prevention of mast collapse particularly challenging.

SUMMARY

Certain aspects of the subject matter herein can be implemented as a drilling rig system. The drilling rig system includes a mast that includes one or more front legs, one or more rear legs positioned opposite the one or more front legs, and a crown block at the top of the mast. The system also includes a raising line coupled to the crown block or the one or more rear legs and configured to apply a first force to the mast. The first force acts in a direction opposing a second force generated by the weight of the mast as the mast pivots between a substantially horizontal position and a substantially vertical position. The system also includes a drawworks assembly coupled to the raising line and configured to pull the raising line to generate the first force, and a telescoping spring assembly coupled to the one or more front legs. The telescoping spring assembly is configured to apply a third force to the mast that acts in the direction opposing the second force.

An aspect combinable with any of the other aspects can include the following features. The telescoping spring assembly includes a compression spring that is in an uncompressed state when the mast is in the substantially vertical position and that compresses as the mast is lowered from the substantially vertical position to the substantially horizontal position.

An aspect combinable with any of the other aspects can include the following features. The third force has a magnitude of approximately zero when the mast is in the substantially vertical position.

An aspect combinable with any of the other aspects can include the following features. The third force is less than the second force when the mast is in an intermediate position between the substantially vertical position and the substantially horizontal position.

An aspect combinable with any of the other aspects can include the following features. The third force is equal to the second force when the mast is in the substantially horizontal position.

An aspect combinable with any of the other aspects can include the following features. The third force is less than the first force when the mast is not in the substantially horizontal position.

An aspect combinable with any of the other aspects can include the following features. The telescoping spring assembly includes a coil spring.

An aspect combinable with any of the other aspects can include the following features. The coil spring is enclosed in a telescoping housing.

An aspect combinable with any of the other aspects can include the following features. The one or more front legs includes a pair of front legs and the telescoping spring assembly includes a pair of springs in respective telescoping housings coupled to the pair of front legs.

An aspect combinable with any of the other aspects can include the following features. The telescoping spring assembly is configured to absorb at least a portion of a kinetic energy of the mast in the event of a failure of the raising line or drawworks that causes the rig to fall to the substantially horizontal position.

Certain aspects of the subject matter herein can be implemented as a method. The method includes applying, via a raising line, a first force to a mast of a drilling rig. The first force acts in a first direction opposing a second force in a second direction. The second force is generated by a weight of the mast as the mast pivots between a substantially horizontal position and a substantially vertical position. The mast includes one or more front legs and one or more rear legs opposite the one or more front legs, and a crown block at the top of the mast. The raising line is coupled to the crown block or the one or more rear legs, and the first force is generated by a drawworks assembly coupled to the raising line. The method also includes applying, by a telescoping spring assembly coupled to the one or more front legs, a third force acting in the first direction opposing the second force.

An aspect combinable with any of the other aspects can include the following features. The telescoping spring assembly includes a compression spring that is in an uncompressed state when the mast is in the substantially vertical position and that compresses as the mast is lowered from the substantially vertical position to the substantially horizontal position.

An aspect combinable with any of the other aspects can include the following features. The third force has a magnitude of approximately zero when the mast is in the substantially vertical position.

An aspect combinable with any of the other aspects can include the following features. The third force is less than the second force when the mast is in an intermediate position between the substantially vertical position and the substantially horizontal position.

An aspect combinable with any of the other aspects can include the following features. The third force is equal to the second force when the mast is in the substantially horizontal position.

An aspect combinable with any of the other aspects can include the following features. The third force is less than the first force when the mast is not in the substantially horizontal position.

An aspect combinable with any of the other aspects can include the following features. The telescoping spring assembly includes a coil spring.

An aspect combinable with any of the other aspects can include the following features. The coil spring is enclosed in a telescoping housing.

An aspect combinable with any of the other aspects can include the following features. The one or more front legs includes a pair of front legs and the telescoping spring assembly includes a pair of springs in respective telescoping housings coupled to the pair of front legs.

An aspect combinable with any of the other aspects can include the following features. The method also includes absorbing, by the telescoping spring assembly, at least a portion of a kinetic energy of the mast in response to a failure of the raising line that causes the rig to fall to the substantially horizontal position.

The details of one or more embodiments are set forth in the accompanying drawings and the description below. Other features, objects, and advantages will be apparent from the description and drawings, and from the claims.

DETAILED DESCRIPTION

The present disclosure describes systems, apparatus, and methods for protecting a mast of a drilling rig and associated equipment as it is raised to a vertical position or lowered to a horizontal position.

The weight of the mast during raising or lowering operations can cause strain and/or wear and tear on the mast and/or the equipment used to raise and lower the mast. Moreover, a failure of a raising device (such as a raising line and/or a drawworks) can cause an uncontrolled fall of the mast from the vertical to the horizontal position. The kinetic energy from such a fall could cause great damage to rig system and surrounding equipment and/or personnel.

In some embodiments, the system, apparatus, and methods are configured to reduce such strain and wear and tear on the raising equipment and on prevent collapse of or damage to the drilling rig mast, for example, following failure of one or more of the mast raising devices.

Figure 1:
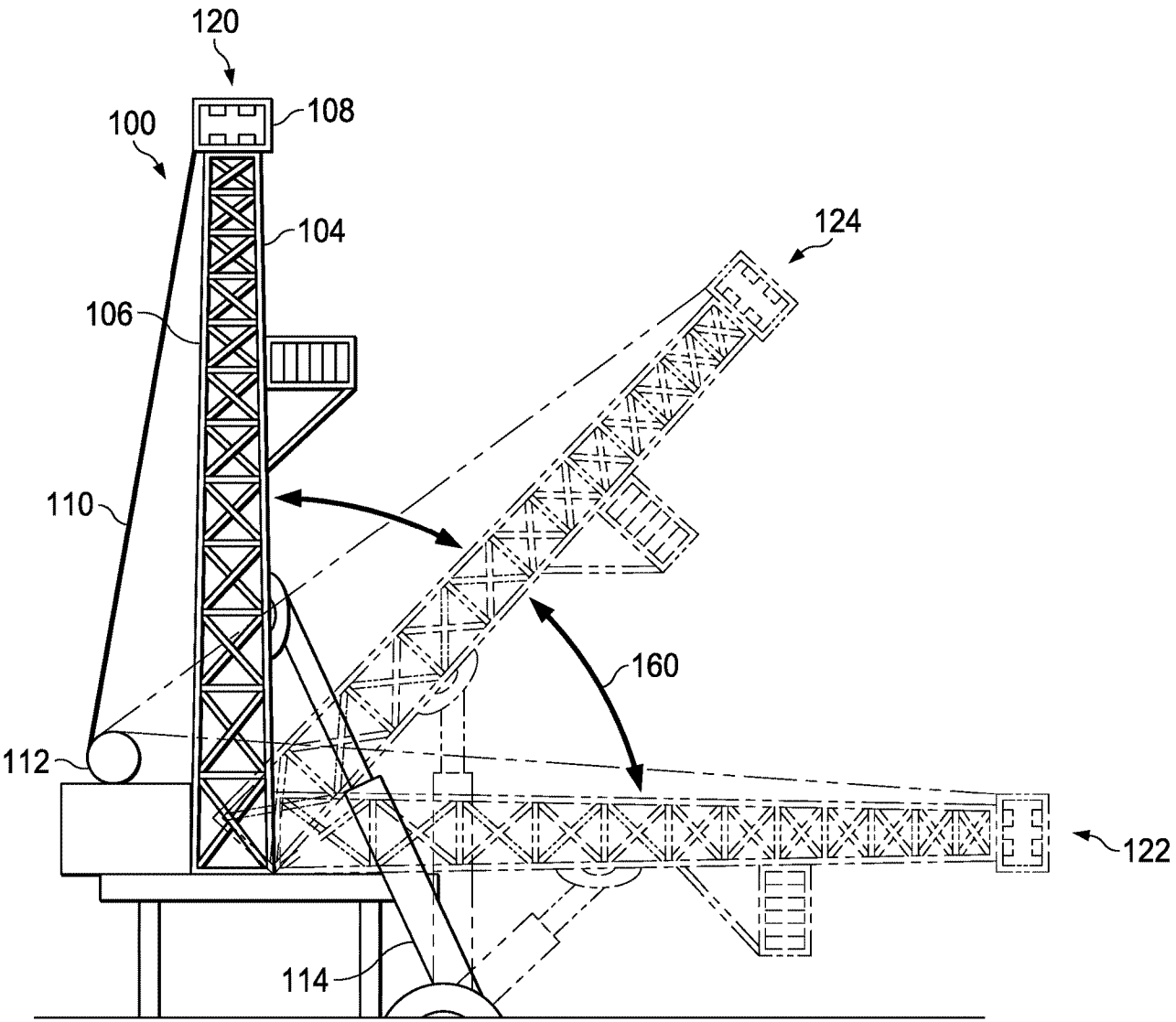
FIG. 1 is a schematic illustration of a drilling rig system in accordance with an embodiment of the present disclosure.

FIG. 1 is a schematic illustration of a drilling rig system 100. The drilling rig system 100 of FIG. 1 includes a drilling rig mast 102. In some embodiments, mast 102 includes one or more front legs 104 and one or more rear legs 106, with a crown block 108 at the top of the mast. In some embodiments, mast 102 has a rectangular cross-section, with a pair of front legs 104 opposite a pair of rear legs 106. Drilling system 100 also includes a raising system. In the illustrated embodiment, the raising system includes drawworks 112 connected to a raising line 110, which is in turn connected to crown block 108. In some embodiments, raising line 110 can be connected to rear legs 106 instead of crown block 108, or to another suitable location on mast 102. In some embodiments, the system can include multiple raising lines. In some embodiments, instead of, or in addition to, a drawworks and raising line, the system can include hydraulic pistons and/or another other suitable raising system. Drilling system 100 also includes telescoping spring assembly 114, described in further detail below.

FIG. 1 shows mast 102 in three different positions: a substantially vertical position 120, a substantially horizontal position 122, and an intermediate position 124 wherein the mast is positioned part way between substantially vertical position 120 and substantially horizontal position 122. Mast 102 may be transported to a wellsite in substantially horizontal position 122. For example, in some embodiments, mast 102 may be positioned on a mobile drill rig configured to transport mast 102 while in substantially horizontal position 122. Upon arrival at a wellsite, drawworks 112 can pull on raising line 110 (using an on-board engine or other means), which applies a force to the mast that opposes the force that is generated by the weight of mast 102, thereby allowing the operator to pivot mast 102 between substantially horizontal position 122 and substantially vertical position 120.

In the illustrated embodiment, vertical position 120 can be the operational position of rig system 100. Specifically, while in substantially vertical position 120 and positioned over a wellbore, mast 102 can be used to conduct wellsite operations (such as drilling or workover operations). For example, a drill string or other equipment can be used for such operations, and the weight of such equipment can be supported by crown block 108 as it is raised out of, lowered into, or moved within the wellbore. When operations are complete or for other reasons, mast 102 can be lowered to substantially horizontal position 122. Mast 102 can then, for example, be transported (while in the substantially horizontal position) to another wellsite.

In the illustrated embodiment, telescoping spring assembly 114 is coupled to front legs 104. As described in more detail in reference to FIGS. 2 and 3, spring assembly 114 is configured to apply a force to the mast in a direction opposing the force generated by the weight of the mast.

Figure 2:
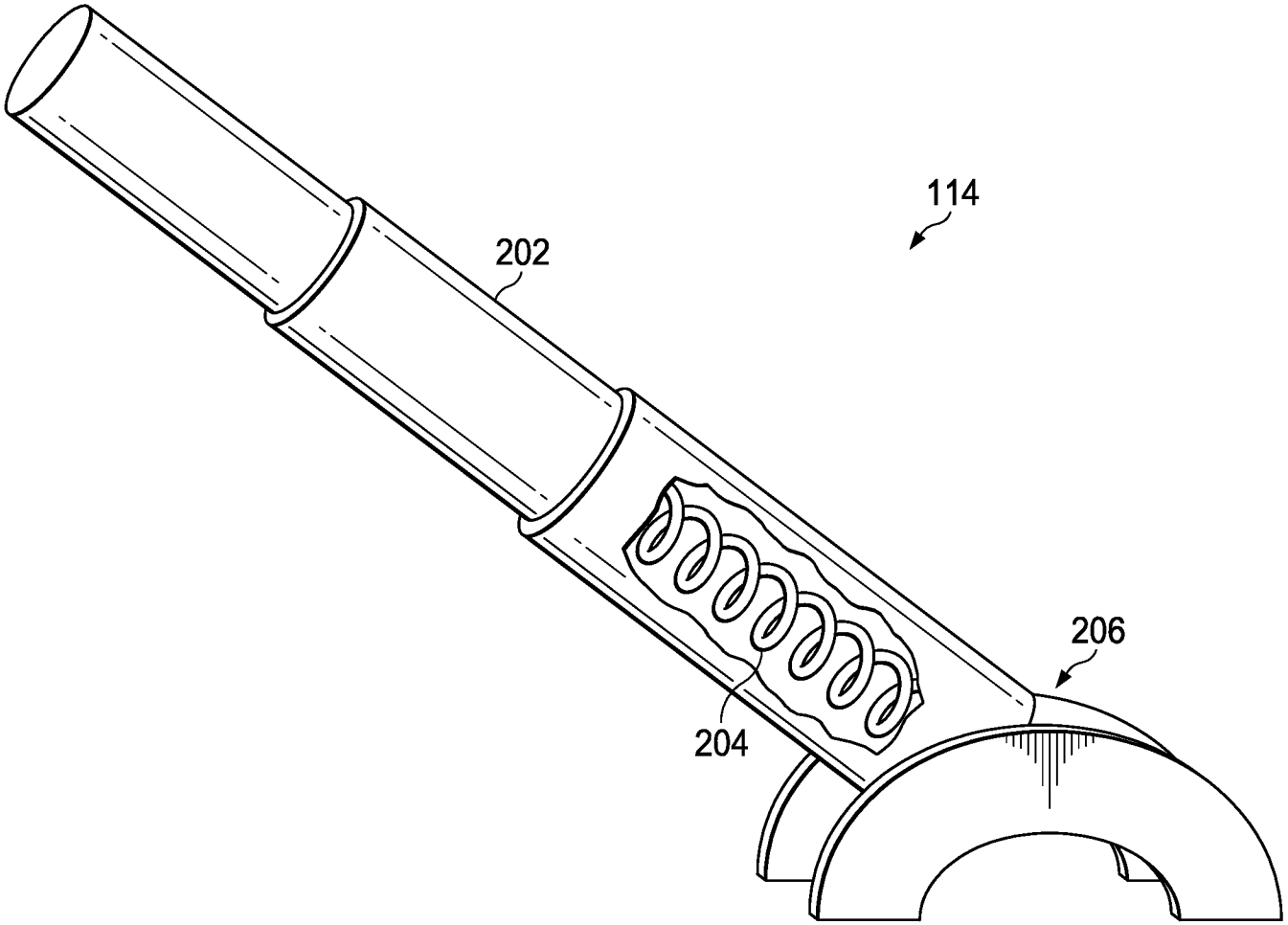
FIG. 2 is a schematic illustration of a telescoping spring assembly in accordance with an embodiment of the present disclosure.

FIG. 2 is a schematic illustration showing more details of telescoping spring assembly 114 of FIG. 1, in accordance with some embodiments of the present disclosure. Referring to FIG. 2, telescoping spring assembly 114 includes a housing 202 which includes telescoping cylinders and a compression spring 204 within housing 202. In some embodiments, compression spring 204 is a coil spring. In some embodiments, compression spring 204 can be a gas spring or another suitable spring type. Hinge 206 allows spring assembly 114 to pivot as the mast pivots between the horizontal and vertical positions.

In the embodiment illustrated in FIGS. 1 and 2, spring assembly 114 includes one compression spring 204. In some embodiments, telescoping spring assembly 114 can include two or more compression springs, for example, nested, parallel, or in series. In some embodiments, mast 102 can include a pair of front legs 104, and spring assembly 114 can include a pair of spring housings 202, each connected a respective one of the pair of front legs 104 and each containing one or more springs 204.

Figure 3:
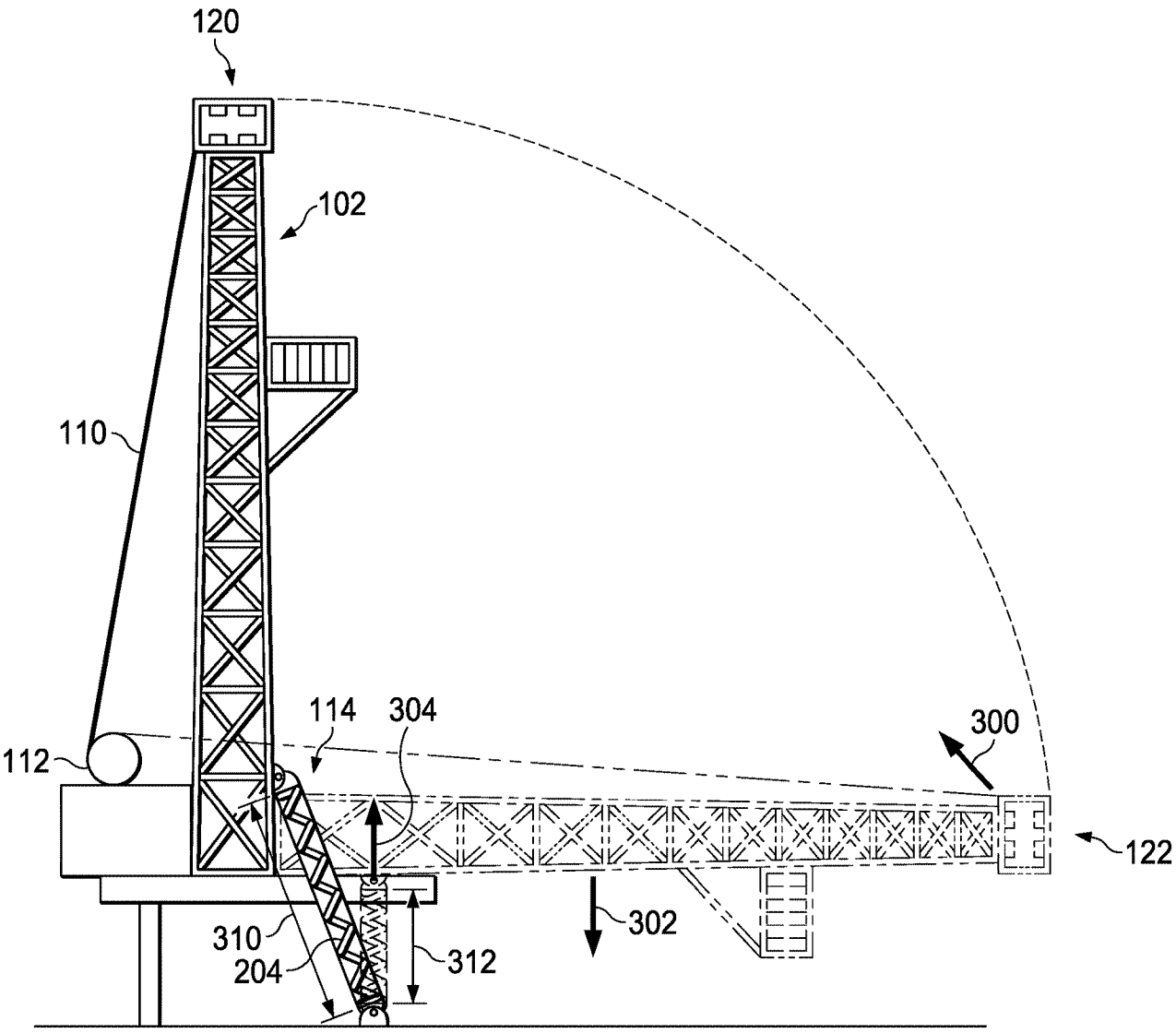
FIG. 3 is a schematic illustration of compression of a telescoping spring assembly and related forces affecting a drilling rig mast in accordance with an embodiment of the present disclosure.

Referring to FIG. 3, raising line 110 as pulled by drawworks 112 applies a first force 300 to mast 102 in a direction opposing a second force 302 generated by the weight of the mast. Telescoping spring assembly 114 applies a third force 304 to the mast, likewise in a direction opposing second force 302. By applying force 304, telescoping spring assembly 114 decreases the force 300 necessary to be applied by raise line 110 to raise and lower mast 102 between vertical position 122 and horizontal position 122, thus decreasing the work required by drawworks 112 and reducing the strain and wear and tear on raising line 110 and drawworks 112.

In the illustrated embodiment, in substantially vertical position 120, spring 204 of spring assembly 114 has a first length 310, "L1." When spring 204 is in a compressed state it has a shorter, second length 312, "L2." The magnitude of third force 304 depends upon the extent of compression of spring 204 and the stiffness or spring constant:

$$F=-k*D$$

where F is the magnitude of force 304, D is the extent of compression (L1-L2), and k is the spring constant (or "stiffness") of the spring. In some embodiments, compression spring 204 is configured such that it is in an uncompressed (relaxed) state when mast 102 is in the substantially vertical position (D=0), such that the magnitude of third force 160 applied to mast 102 when the mast is in substantially vertical position 120 is zero (or about zero) or is otherwise relatively small. Accordingly, by keeping spring 204 in a relaxed state when mast 102 is in vertical position 120 (for example, during well operations), strain and wear and tear on spring 204 is minimized. Furthermore, when operations are complete and the operator decides to pivot mast 102 from the vertical position 120, only a relatively small force is required to begin to such a pivot (i.e., the relatively small magnitude of third force 304 when mast 102 is at or near vertical position 120 allows mast 102 to be easily and efficiently "tipped" from the vertical position as such lowering operations begin).

As mast 102 is lowered from substantially vertical position 120 to substantially horizontal position 122, spring 204 begins to compress (such that D increases) and force 304 accordingly increases. In some embodiments, the number and spring constant(s) of compression spring(s) 204 is selected such that third force 304 is less than second force 302 when the mast is in an intermediate position (such as position 124 shown in FIG. 1) but is equal to second force 302 when mast 102 is in the substantially horizontal position 122 (i.e., D is at its maximum). In this way, the work or energy is required from drawworks 112 to raise and lower mast 102 is minimized, and mast 102 can be moved in a more controlled and safe matter, and impact of mast 102 on rig components is minimized or avoided as mast 102 is raised and lowered. Furthermore, in the event of a failure of drawworks 112 and/or raising line 110 (and or other raising systems or system components) such that the mast falls towards substantially horizontal position 122, spring 204 can absorb at least a portion of a kinetic energy of mast 102. In this way, damage to equipment and personnel in the event of such a failure can be minimized or avoided.

While this specification contains many specific implementation details, these should not be construed as limitations on the scope of any claims or of what may be claimed, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A drilling rig system comprising:

a mast, the mast comprising:

one or more front legs;

one or more rear legs positioned opposite the one or more front legs; and a crown block at the top of the mast;

a raising line coupled to the crown block or the one or more rear legs and configured to apply a first force to the mast, the first force acting in a direction opposing a second force generated by the weight of the mast as the mast pivots between a substantially horizontal position and a substantially vertical position;

a drawworks assembly coupled to the raising line and configured to pull the raising line to generate the first force; and a telescoping spring assembly coupled to the one or more front legs, the telescoping spring assembly comprising one or more compression springs selected to have lengths and spring constants such that:

the one or more compression springs are in an uncompressed, relaxed state and apply substantially no force to the one or more front legs when the mast raised to the substantially vertical position; and if the raising line or drawworks fails, then the mast, as it falls due to the failure, pivots towards the substantially horizontal position and the one or more compression springs absorb at least a portion of a kinetic energy of the falling mast and applies to the mast a third force acting in the direction opposing the second force substantially equal to the second force upon the mast then arriving at the substantially horizontal position.

2. The system of claim 1, wherein the third force is less than the second force when the mast is in an intermediate position between the substantially vertical position and the substantially horizontal position.

3. The system of claim 1, wherein the third force is less than the first force when the mast is not in the substantially horizontal position.

4. The system of claim 1, wherein the telescoping spring assembly comprises a coil spring.

5. The system of claim 4, wherein the coil spring is enclosed in a telescoping housing.

6. The system of claim 1, wherein the one or more front legs comprises a pair of front legs and the telescoping spring assembly comprises a pair of springs in respective telescoping housings coupled to the pair of front legs.

7. A method comprising:

selecting one or more compression springs for a telescoping spring assembly configured to be attached to one or more front legs of a mast of a drilling rig system, the mast comprising:

one or more rear legs positioned opposite the one or more front legs;

a crown block at the top of the mast;

a raising line coupled to the crown block or the one or more rear legs and configured to apply a first force to the mast, the first force acting in a direction opposing a second force generated by the weight of the mast as the mast pivots between a substantially horizontal position and a substantially vertical position; and a drawworks assembly coupled to the raising line and configured to pull the raising line to generate the first force, wherein the one or more compression springs are selected to have lengths and spring constants such that:

the one or more compression springs are in an uncompressed, relaxed state and apply substantially no force to the one or more front legs when the mast raised to the substantially vertical position; and if the raising line or drawworks fails, then the mast, as it falls due to the failure, pivots towards the substantially horizontal position and the one or more compression springs will absorb at least a portion of a kinetic energy of the falling mast and will apply to the mast a third force acting in the direction opposing the second force substantially equal to the second force upon the mast then arriving at the substantially horizontal position;

attaching the telescoping spring assembly to the one or more front legs of the mast and applying, via the raising line, the first force to the mast.

8. The method of claim 7, wherein the third force is less than the second force when the mast is in an intermediate position between the substantially vertical position and the substantially horizontal position.

9. The method of claim 7, wherein the third force is less than the first force when the mast is not in the substantially horizontal position.

10. The method of claim 7, wherein the telescoping spring assembly comprises a coil spring.

11. The method of claim 10, wherein the coil spring is enclosed in a telescoping housing.

12. The method of claim 7, wherein the one or more front legs comprises a pair of front legs and the telescoping spring assembly comprises a pair of springs in respective telescoping housings coupled to the pair of front legs.

13. The method of claim 7, further comprising absorbing, by the telescoping spring assembly, at least a portion of a kinetic energy of the mast in response to a failure of the raising line that causes the rig to fall to the substantially horizontal position.

* * * * *